US007431532B2

(12) United States Patent
Lidster

(10) Patent No.: US 7,431,532 B2
(45) Date of Patent: Oct. 7, 2008

(54) AUTOMATED TRAFFIC CONE HANDLING MACHINE

(76) Inventor: Scott Lidster, CASA P.O. Box 993365, Redding, CA (US) 96099-3365

( * ) Notice: Subject to any disclaimer, the term of this patent is extended or adjusted under 35 U.S.C. 154(b) by 92 days.

(21) Appl. No.: 11/158,727

(22) Filed: Jun. 22, 2005

(65) Prior Publication Data

US 2006/0291957 A1 Dec. 28, 2006

(51) Int. Cl.
*E01F 9/01* (2006.01)

(52) U.S. Cl. ..... 404/6; 414/539; 414/551

(58) Field of Classification Search ..... 404/73, 404/6; 414/539, 551
See application file for complete search history.

(56) References Cited

U.S. PATENT DOCUMENTS 3,750,900 A * 8/1973 Piercey ..... 414/788.2
5,054,648 A * 10/1991 Luoma ..... 221/185
5,244,334 A * 9/1993 Akita et al. ..... 414/502
5,338,129 A * 8/1994 Oden ..... 404/9
5,525,021 A * 6/1996 Larguier ..... 414/551
6,056,498 A * 5/2000 Velinsky et al. ..... 414/555
6,158,948 A * 12/2000 Calvert ..... 414/501
6,726,434 B2 * 4/2004 Orthaus et al. ..... 414/539
6,752,582 B2 * 6/2004 Garcia ..... 221/185
2004/0057824 A1 * 3/2004 Orthaus et al. ..... 414/789.7

* cited by examiner

*Primary Examiner*—Raymond W Addie
(74) *Attorney, Agent, or Firm*—Joseph L. Strabala

(57) ABSTRACT

Through the use of a rail system having spaced apart rails tracking above and along a roadway with arcuate guides associated with each rail and a cone magazine sequentially delivering traffic cones in a horizontal position between the rails in front of the arcuate guides, each horizontally disposed cone will be brought to an upright position when the top of its base contacts the guides as a result of friction with the roadway of one edge of the base of the traffic cone and movement of the guides with the rails. In one embodiment the magazine includes a mechanical arm with a cone clamp at its distal end, arranged to move the cone clamp from a cone storage to a location between the rails to sequentially deliver cones to the rail system. An auxiliary system is provided to reposition upright traffic cone from the rail system in a taper for closing off access to roadways.

The arcuate guides can be removed, after which the rail system can be used to collect traffic cones by sequentially knocking them down between the rails and employing the arm with the cone clamp to sequentially transport such cones from a location between the rails to a cone storage in the magazine.

18 Claims, 13 Drawing Sheets

AUTOMATED TRAFFIC CONE HANDLING MACHINE

FIELD OF THE INVENTION

The present invention relates to an automated system for the deposition and collection of traffic cones on roadway surfaces, and more particularly to an improved traffic cone setting device for automatically depositing traffic cones on roadway surfaces and an automatic device for collecting the same.

BACKGROUND OF THE INVENTION

Traffic cones are used on roadways to visually alert motorists to the presence of construction, to delineate or separate moving lanes of traffic from roadside work zones, to close off particular street regions to traffic, or the like. Typically such cones are used as temporary traffic control devices and placed by crews on the roadway to provide guidance to motorists.

The cones themselves are generally of a common design having a rectangular base and a centrally positioned tapering cone extending from the base to the top. These cones are made of an elastomer composition which is flexible but has sufficient rigidity so that the cone maintains its configuration. However, such cones when exposed to roadway temperatures over 100 degrees F., become very flexible and difficult to handle due to the increased flexibility without compromising the ability to maintain their configuration when set on a roadway. It is not uncommon for temperatures on roadways where cones are used, to hit temperatures in ranges of 120 degrees F. in the summer time, sharply increasing their flexibility.

Known prior art cone distributing and collecting devices include U.S. Pat. Nos. 5,054,648; 5,244,334; 4,747,525; 5,213,464; 6,726,344 and U.S. Design Pat. 254,429.

Normally a supply of such traffic cones is carried on a truck or similar vehicle. Often such traffic cones are manually deposited or placed upon a particular roadway by workmen who place the individual traffic cones on a roadway, by hand, from a supply of such cones carried on the vehicle, as the vehicle is driven along the roadway. Such workmen place the individual traffic cones upon the roadway surface at predetermined spaced intervals along the particular route being traveled by the truck or vehicle. For example see U.S. Pat. No. 6,364,400, issued to Unrath, illustrating a vehicle with special platforms for personnel to stand when manually placing cones on a roadway. From such a platform a worker can also pick up cones from a roadway when the construction or other work is completed or stopped.

Since the manual distribution of traffic cones and the manual collection of traffic cones is labor intensive and typically requires crews of three or more workers, an automated system for the placing of such cones on a roadway and to collect of the cones after the construction is completed or stopped, is sought to eliminate the expense of multiple workers hand placing or collecting traffic cones on a roadway.

When manually handling the traffic cones, workers are placed in dangerous situations which can be eliminated if such cone handling is accomplished by an automated mechanisms. Incidents, during manual traffic cone placement, or collection, on roadways, include situations where workers have accidentally fallen from vehicles, been hit by motorists and/or suffered back strain. Some workers have suffered serious injuries, including fatal injuries.

These incidents are not entirely unanticipated in view of the fact that sometimes the cones are placed on the roadway while the worker's vehicle is moving alongside oncoming or passing motorists in adjacent traffic lanes.

Moreover a truck or vehicle used to distribute or collect the cones, may undergo unexpected movements, such as change in direction, braking or acceleration which further subjects the personnel on vehicles distributing the cones, or collecting them, to unanticipated forces. In addition changes in weather, such as a thunder storm, can add slippery conditions creating an increased risk of accidents when manually handling such cones.

Based on the forging factors there remains a strong need to find ways to automate the distribution of traffic cones and the collection of the same, without personnel manually doing these chores. Some prior art system developed for this purpose, which have numerous problems, are the automated systems proposed in U.S. Pat. No. 5,244,334 issued to Akita et al.; U.S. Pat. No. 5,213,464 issued to Nicholson et al.; U.S. Pat. No. 5,054,648 issued-to Luoma, and U.S. Pat. No. 6,056,498 issued to Velinsky et al.

As indicated the typical traffic cones are constructed of elastomer which is flexible, but yet sufficiently rigid to maintain the shape of the traffic cone. Due to these characteristics it is very difficult to manipulate such cones with automatic systems, such as those described above. Manipulation of the cones in automated machines is compounded by normal wear and tear of the cones, along with the fact that elastomers used in construction of the traffic cones tend to have high frictional interaction with prior art mechanical devices employed to handle them. Further the flexibility of the cones increase as the temperatures increase adding additional complexity to controlling them in automated machines.

Due to these cone characteristics, problems have occurred in attempts to automate the distribution, and collection of such cones, from jams, hang ups, and similar malfunctions. Thus many prior art automated systems have failed to deliver the anticipated savings expected from automation.

A need continues to exist in the art for an improved, more reliable, system or apparatus for depositing traffic cones onto roadway surfaces, and collection of the cones therefrom, wherein workmen will be not exposed to the dangers noted or those associated with oncoming or parallel vehicle traffic.

OBJECTS OF THE INVENTION

Accordingly, it is an object of the present invention to provide a new and improved apparatus for depositing or placing traffic cones onto roadway surfaces which is more reliable than prior art systems.

It is also an object of the present invention to provide a less complex and more economical automated system for depositing traffic cones on roadway surfaces without manual labor.

A further object of the present invention is to provide a new and improved apparatus for collecting traffic cones previously placed on roadway surfaces.

Also it is an object of the present invention to provide new and improved apparatus for depositing or placing traffic cones onto a roadway which is less likely to jam or malfunction due to the simplicity in its design.

A further object of the present invention is the provision of a rail system for placing the traffic cones on a roadway which has no moving parts and which can be easily converted to an alternate structure to collect the traffic cones once depositing traffic cones on a roadway is no longer required.

It is also an object of the present invention to enable the apparatus to handle, within reason, different sizes of traffic cones when depositing the same or collecting the same on a roadway.

A desired object of the present invention is the provision of timed traffic cone placement on a roadway so that the spacing of the cones is uniform.

A novel object is also to provide an automatic system for distribution of traffic cones which automatically indexes the cones in a taper, as such cones are placed on the roadway to close a traffic lane or similar thoroughfare.

Other objects of this invention will be apparent from this description of the present invention and the accompanying drawings.

SUMMARY OF THE INVENTION

The foregoing and other objects can be achieved according to the teachings and principles of the present invention through the provision of an improved cone apparatus, for depositing traffic cones on roadway surfaces at spaced locations by employing a vehicle mountable rail system having two spaced apart rails slightly elevated above a roadway and oriented parallel to the longitudinal axis of the rails, the rails each having an arcuate guide adjacent to their terminal end which guides are operable to engage the top of the base of a traffic cone when the latter is in a horizontal position and to vertically orient the cone to an upright position as the rails move forward, due to the roadway friction on one edge of the cone base and the guides engaging the top of the cone's base, plus a cone magazine means cooperating with the rail system operable to sequentially deposit a horizontally disposed traffic cone between the rails one after another as the rails move forward along a roadway.

The magazine can include a mechanical arm with a clamp for holding the base of a traffic cone, enabling the arm to move a cone from a vehicle to a horizontal position between the rails and can, in reverse fashion, sequently move a traffic cone in horizontal position located between the rails from the roadway to a vehicle for stowage.

Typically the vehicle is operated in reverse for the collection of standing cones with a bar to knock down a vertical cone as it passes between the rails so its base contacts a sensor causing thereby actuating the clamp to secure the base of a traffic cone therein then cycling the mechanical arm from the roadway and transporting the secured cone to a storage area.

The invention also includes the method of mechanically placing a traffic cone on a roadway in a horizontal position between two spaced apart rail members with arcuate guides at their distal ends and moving the rails parallel to their longitudinal axis to bring the arcuate guides into contact with the surface of the top of the base of such cone whereby continued movement of the rails in the same direction is operable to orient the traffic cone from a horizontal position to a vertical position due to the cone's contact with the arcuate guides and the friction of the surface of the roadway on one edge of the base.

DESCRIPTION OF THE DRAWINGS

FIG. 12 is a perspective, with parts broken away, illustrating an ad on system for disposing traffic cones on a taper, such as when closing off a traffic lane or the like;

DESCRIPTION OF A PREFERRED EMBODIMENT

Figure 1:
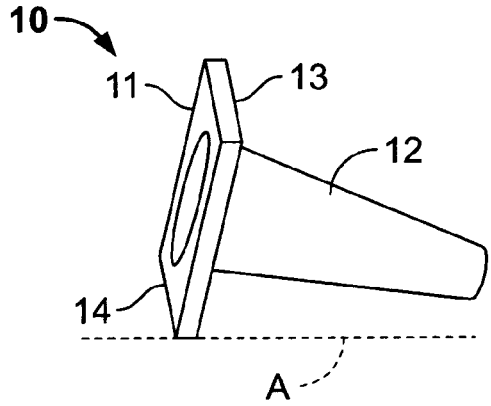
FIG. 1 is an elevation of a traffic cone lying on a roadway A.

At the heart of the invention is a simple but elegant concept for handling traffic cones on roadway surfaces. This novel concept can be appreciated by reference to FIGS. 1, 2 and 3 where a traffic cone 10, illustrated lying on the roadway A in a horizontal position between the spaced apart rails (rails not shown in FIGS. 1 through 3), is brought to an upright position as the rails move in the direction of arrow B (see FIG. 2).

As can be seen in these figures, each traffic cone has a rectangular base 11 with an integral conical section 12 extending therefrom to the top to complete the cone, which is a common design for such cones. This hollow conical section does not cover the entire top 13 of the rectangular base, allowing the top of the base which is engaged for manipulating the traffic cones according to this invention.

In operation as the rails move in the direction of arrow B the conical section passes between spaced apart arcuate guides 24 (illustrated in phantom) connected to the rails until these guides contact top 13 of the rectangular base 11 of cone 10. As contact occurs with the arcuate guides, with edge 14 of the base of the cone resting on the roadway A, friction on this edge with the roadway, will first align the cone with the guides and then enable the guides to drive the top of the base in same direction that the rails and attached guides, are moving. As the rails continue to move in the direction of Arrow B the arcuate guides will bring the cone to the position shown in FIG. 3 at which time the cone will swing to an upright position. Any over-travel of the cone will be muted by the ends of the arcuate guides which are only slightly above the top of the rectangular base of the cone it becomes upright. Employing the ends 26 of the guides to stabilizes the cone on the roadway in an upright position, overcomes problems with prior art devices which have difficulty in stabilizing the cones once they are placed on the roadway from a moving vehicle. This problem is solved with the instant invention since the cones are essentially static on the roadway when they are brought to an upright position.

Figure 2:
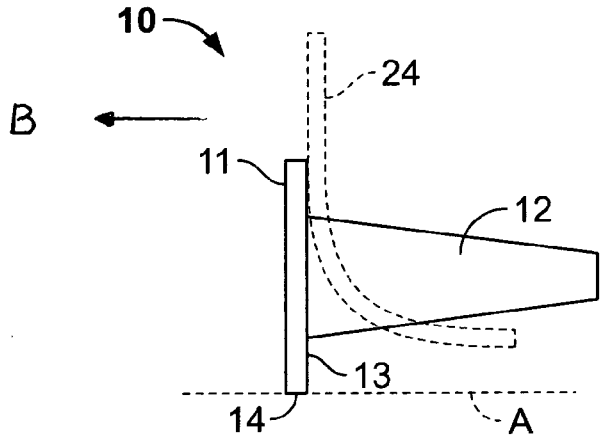
FIG. 2 is an elevation of the traffic cone illustrated in FIG. 1 wherein a cone is shown being manipulated by the arcuate guides (shown in phantom) by contacting the top of the base of the traffic cone as the rails move in the direction of Arrow B.
Figure 3:
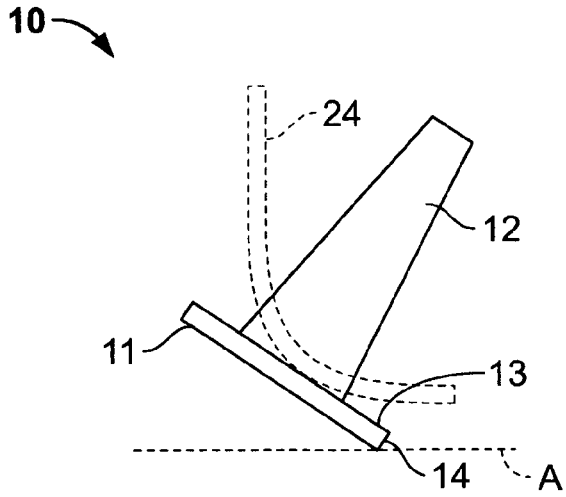
FIG. 3 is an elevation showing the subsequent relationship of the traffic cone and the arcuate guides illustrated in FIG. 2 as the rails continue to move in the direction of Arrow B.
Figure 4:
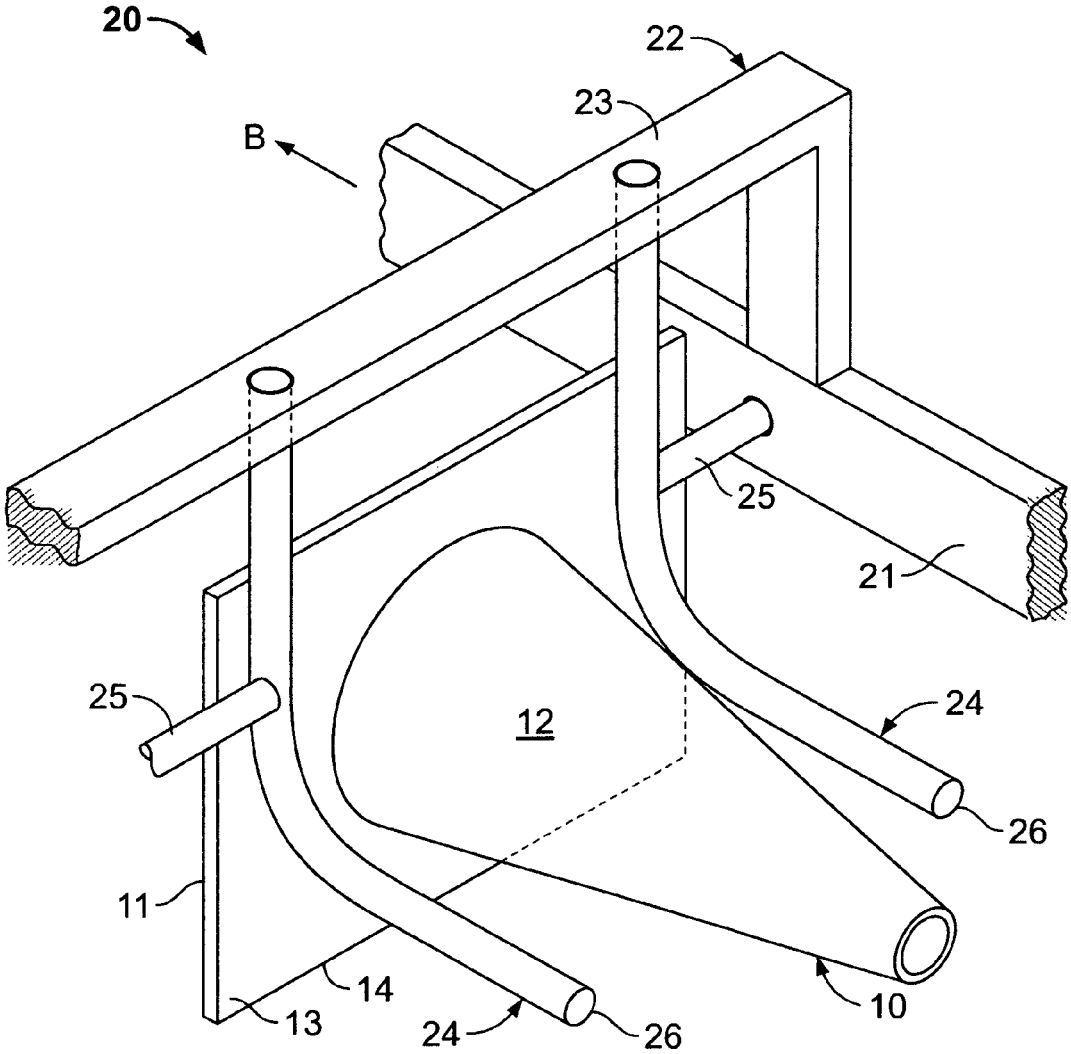
FIG. 4 is a diagrammatic perspective of the rail system, with parts broken away, showing a traffic cone engaged by the arcuate guides as it manipulated to a vertical position.

Having illustrated a principal feature of the invention, in FIGS. 1, 2 and 3, reference is made to FIG. 4 which illustrates more completely the portion of the invention for setting up traffic cones on a roadway. The rail system 20 includes spaced apart rails 21 (one broken away in this figure) which are parallel to one another. A u-shaped cross bar 22 connects these rails to one another and provides clearance for traffic cone 10, in a horizontal position, to pass under this cross bar. Mounted in the top 23 of the cross bar, adjacent to the connection to each rail is a downwardly directed arcuate guide 24, which guides are spaced far enough apart so that the cone section 12 of a traffic cone 10 can pass there between. From FIG. 4 it can be seen the spaced apart rails provide a guide directing a traffic cone there between to the arcuate guides so that these guides will engage the top 13 of base 11 of the traffic cone 10, as the rails move in the direction of Arrow B. An optional stabilizing bar 25 can be used to connect each arcuate guide to its adjacent rail, as illustrated in FIG. 4, but is not normally employed. The location these bars, as shown, will not effect the operation of the arcuate guides when these guides engage the top of the base of a traffic cone.

While the connection of the arcuate guides 24 to the rails 21 in the rail system is shown as fixed in FIG. 4, the connection of these guides to the u-shaped cross bar 22 and their adjacent rail can be made adjustable so that different sized cones can be accommodated in the rail system 20. In addition, as discussed later, the arcuate guides are typically fabricated so that they can be removed for cone collection operations. Moreover as can be seen in FIG. 4 the distal ends 26 of the arcuate guides are generally located only a few inches above the roadway when rail system is mounted on a vehicle, whereby, once the traffic cone achieves an upright position, these ends will prevent over travel of the cone thereby stabilizing it. Note these ends can be extended to achieve increased stabilization, e.g., see commercial embodiment shown in FIG. 14.

Further the arcuate guides 24 are removed when traffic cones are collected by this novel invention, as described hereinafter, see the discussion of the embodiment in FIG. 15, infra.

Figure 5:
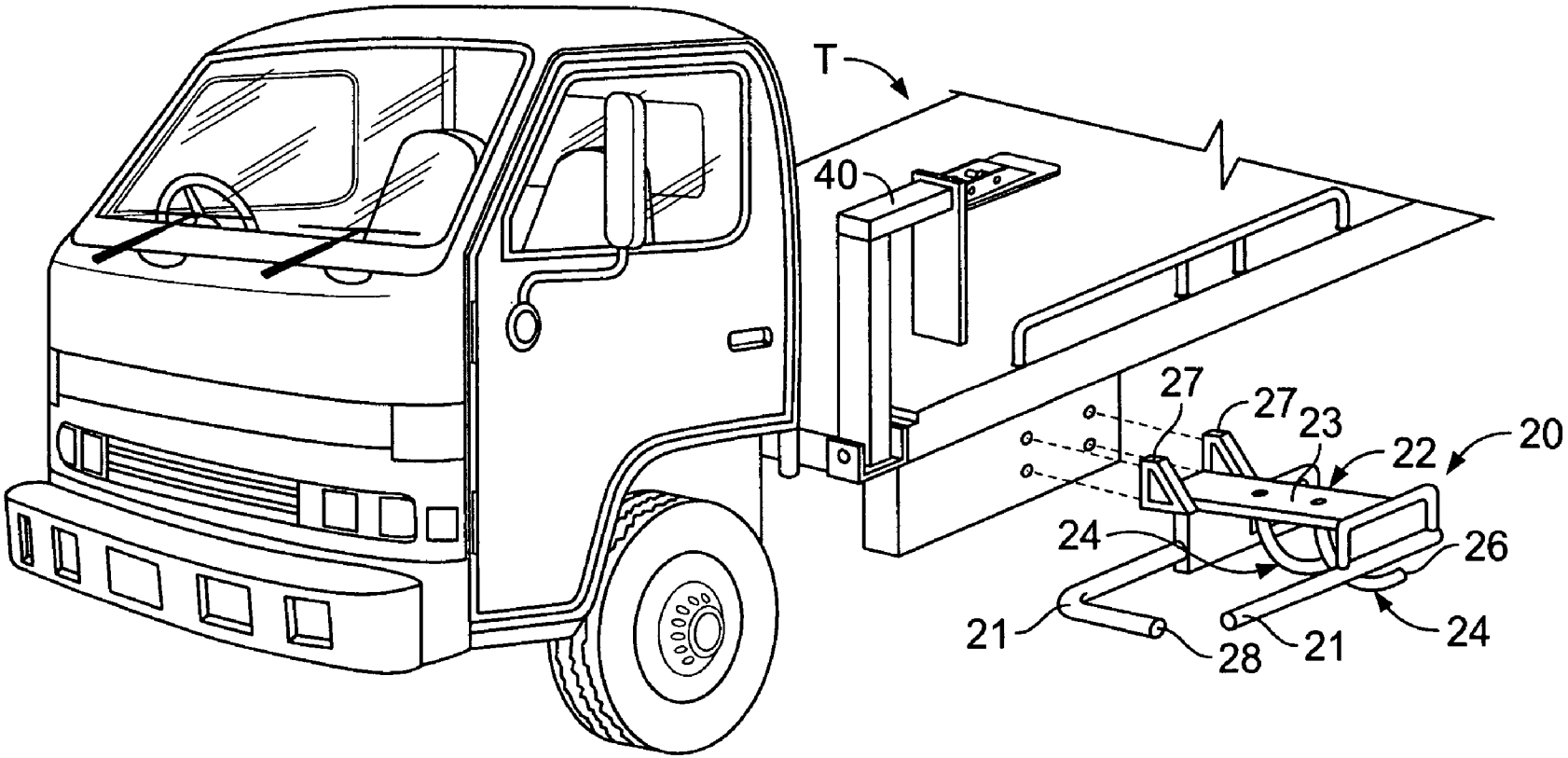
FIG. 5 is a perspective with parts broken away, illustrating a commercial embodiment of the rail system, exploded from its mounting on a typical vehicle.

A commercial embodiment of the rail system is illustrated in FIG. 5, exploded from its typical mounting on vehicle T, which is a typical flat bed truck. As can be seen the rail system 20 mounts on the side of vehicle T with brackets 27 which can be adjusted so that the rails are oriented co-axially with the longitudinal axis of the vehicle. In addition these brackets can include a retracting system (not shown) whereby the rail system can be retracted partially under the bed of the truck when the rail system in not in use. Further these brackets allow the height of the rail system above the roadway to adjusted between 2 inches to 10 inches.

As can be appreciated from FIG. 5 vehicle T provides the forward motion for the for the rail system 20 once a traffic cone is deposited between rails 21 of this system. A gap 28 is provided in one of the rails, illustrated in FIG. 5, facilitates the insertion of a traffic cone between rails from a magazine system by a mechanical arm associated with a cone magazine, as described herein after.

Figure 6:
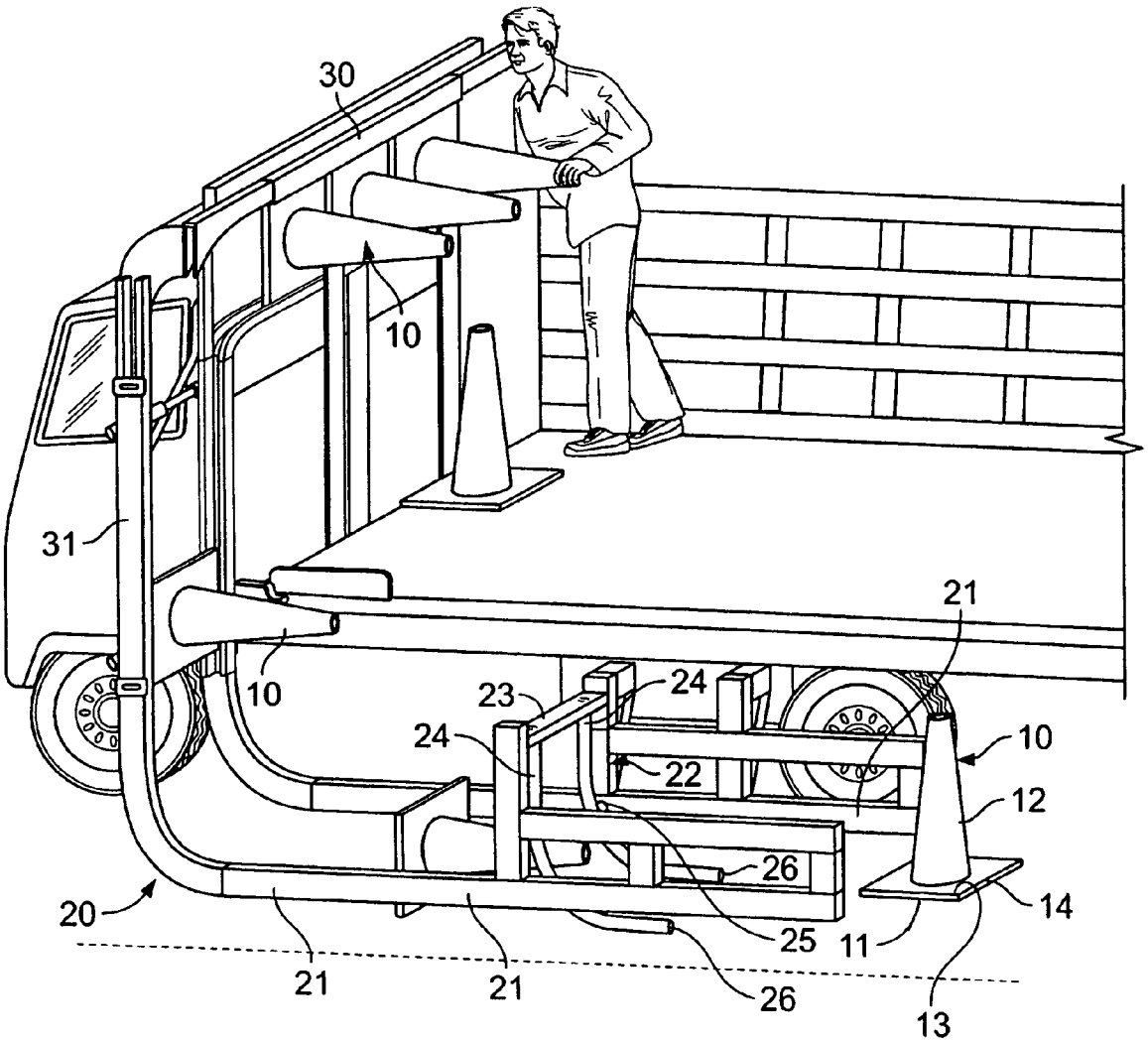
FIG. 6 is a perspective, with parts broken away, illustrating the rail system mounted on a vehicle with a manual magazine to feed traffic cones to the novel rail system.

Typically the rail system 20 is fed by a cone magazine associated with the vehicle on which it is mounted. For example, in FIG. 6 the rail system is mounted on a truck T which includes a hand fed cone magazine 30. In this embodiment a workman on the bed of the truck places the cones in a cone guide which receives the rectangular base of cones and delivers them to a vertical dispensing chute 31. This chute includes a release mechanism (not shown) so that traffic cones 10 in the vertical chute are dropped in the front of the arcuate guides 24 and between the rails 21 of the rail system in timed relationship. When this type of magazine is used, there in no need for gap 28 in the rail system. However, such a manual magazine defeats some of the advantages of a completely automated cone system, i.e., elimination of excess laborers.

Figure 7:
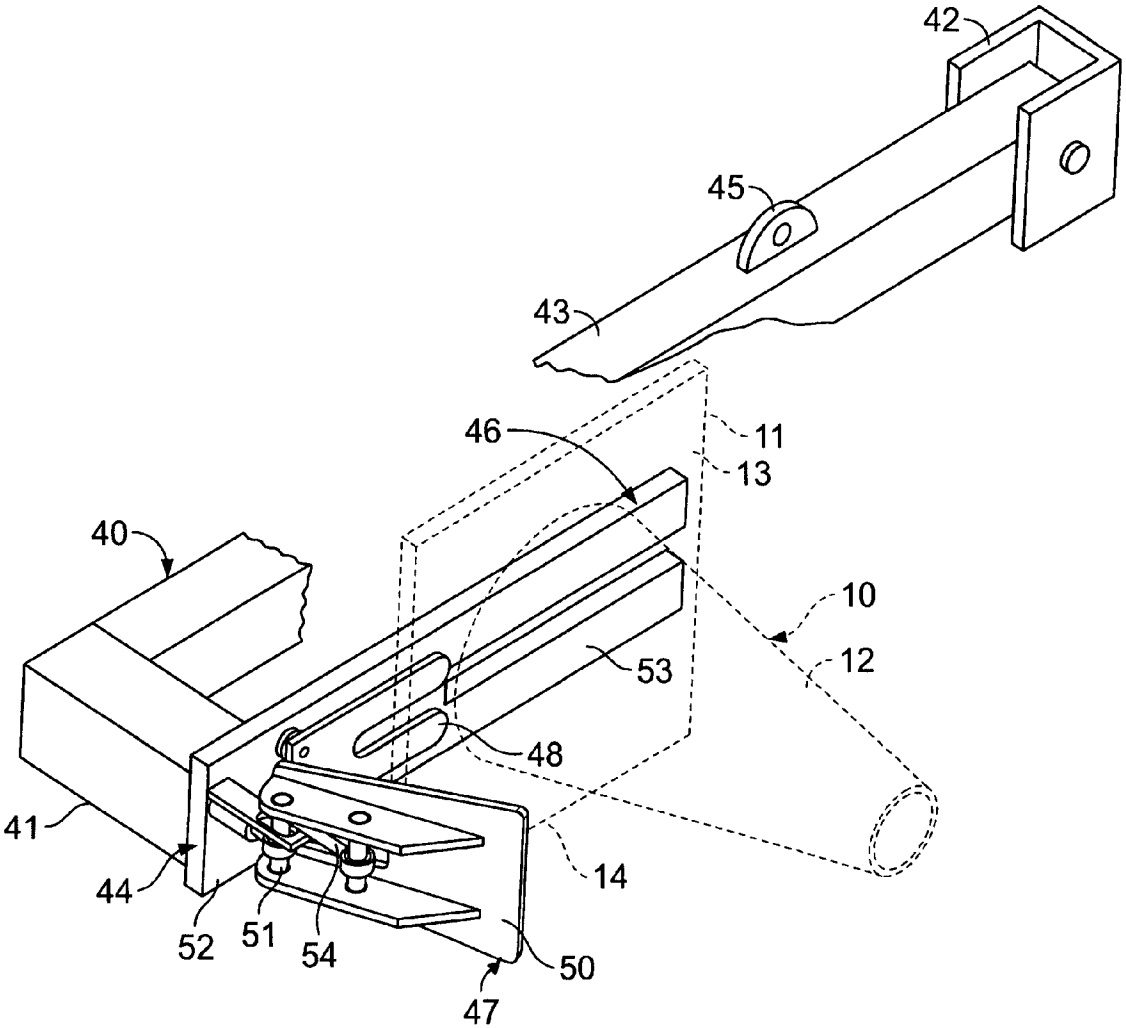
FIG. 7 is a perspective, with parts broken away, of a typical mechanical arm used to transport traffic cones from a conveyor on a vehicle to a position between the rails or transport such a cone from a horizontal position between the rails to a cone storage location on a vehicle.

For more complete automation the cone magazine 30, may include a mechanical arm 40, illustrated in FIG. 7, in place of the chute 31. This arm is mounted on a vehicle, such as truck T as shown in FIG. 5, so that the arm can grip a traffic cone 10 on the bed of the truck and deposit in on the roadway in a horizontal position, between the rails 21 of the rail system 20. Gap 28 in on of the rails 21 provides clearance for the distal end 41 of the arm when it is adjacent to the roadway.

More particularly, the mechanical arm 40 is pivoted on the bed of the vehicle with a bracket 42 so that its arcuate travel is normal to the longitudinal axis of the vehicle T. Thus, as can be appreciated from FIG. 5, the distal end 41 of this arm will swing from above the bed of the vehicle into the gap 28 in the rail system 20. Moreover, such an arm can be mounted on both sides of the vehicle (not shown) to make the novel traffic cone distribution and collection system more versatile in the field. Likewise a separate rail system can be mounted on opposite sides of the vehicle. However, cone distribution or cone collection from both sides of the vehicle are not done at the same time, one side at a time. Typically the operator will activate setting for one side of the vehicle from controls in the cab of the vehicle.

Referring to FIG. 7 mechanical arm 40 for placing and retrieving traffic cones 10 in accordance with the present invention is generally shown. The arm includes a primary lifting arm 43, which is pivoted on a bracket 42, on a vehicle as indicated above. A head 44 is attached to the arm's distal end 41. Typically at a middle point on the top of the arm, a lug 45 is provided for connecting a hydraulic actuator (not shown) to swing this arm from a vertical position when mounted on a vehicle to a position that places the head 44 in the gap 28 of the rail system 20 and returns it to a position over the bed of the vehicle. Other actuators can be employed for articulation of the arm and are within the contemplation of this invention.

The head 44 includes base platform 46, a clamp assembly 47, and a sensor plate 48. Platform 46, attached to the head of arm 40, provides an abutment for the base 11 of traffic cone 10, shown in phantom in FIG. 7. Securing a cone in the head can be effected, as can be seen from viewing FIG. 7, by actuation of a clamping plate 50, which has a pivoted connection 51 on the outboard end 52 of the platform 46, to a closed position. Thus, the clamping plate secures the base of a traffic cone against the face 53 of the platform when closed An actuator a 54 is used to move the clamping plate between its open position (shown in FIG. 7) to a closed position.

When the base 11 of a traffic cone 10 abuts against the platform 46, triggering the sensor 48, see FIG. 7 showing the traffic cone in phantom in such a location, the clamping plate 50 will close on the top 13 of base of the cone, securing the base between the plate and the platform. Once the cone is secured in this fashion, the arm 40 can be actuated to move a cone from the bed of the vehicle to a position between the rails 21.

Figure 15:
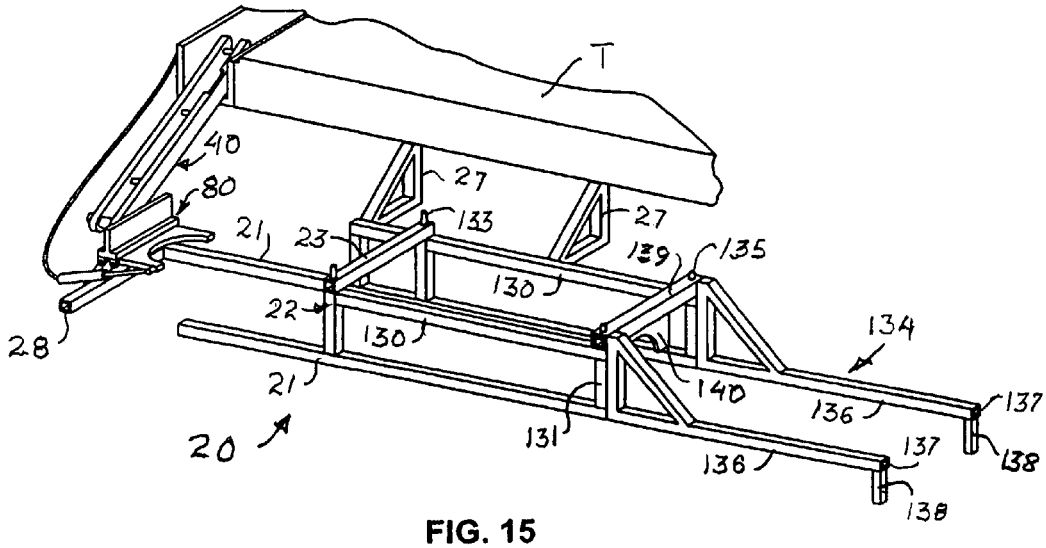
FIG. 15 is a perspective of the rail system, converted to a mode for collecting cones from a roadway.

When collecting traffic cone from a roadway the arcuate guides 24 are removed and a collecting guide shown in FIG. 15 in added. Thereafter the vehicle having the rail systems 20 attached is driven backwards so that traffic cones distributed on the roadway will be guided to locations between the rails 21 as the vehicle progress in this direction. The u-shaped cross bar 22 will knock an upright cone over so that it lies in a horizontal position on the roadway between the rails. As the vehicle continues in its rearward direction the base 11 of the overturned traffic cone 10 will contact the sensor 48 (see FIG. 7) and trigger the clamping plate 50 to close on the top surface 13 of the cone securing the cone in the head 44. Once the clamping plate closes on the base of the cone the arm is raised, moving the secured cone from between the rails to the bed of the vehicle. When the cone is above the bed of the vehicle, the clamping plate releases the secured cone. This feature enables the current invention to automatically retrieve traffic cones from a roadway, as well as to automatically distribute them on a roadway.

The mechanical arm 40, in this embodiment of the cone magazine, can move traffic cones from the vehicle bed to locations between the rails 21 of rail system 20 or, in the alternative, in reverse fashion the arm can move traffic cones from between these rails to the bed of the vehicle, in a fully automatic system.

Figure 8:
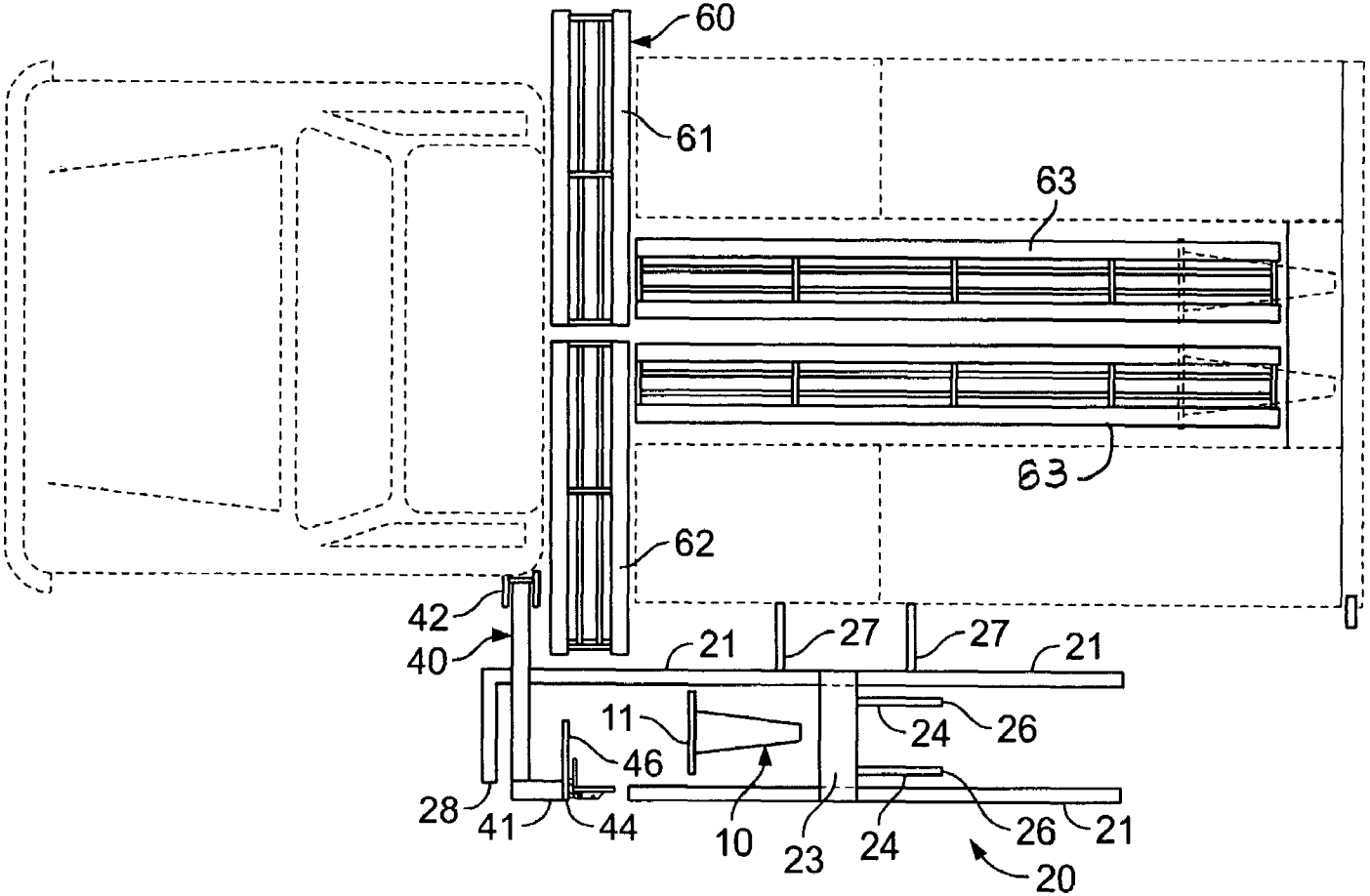
FIG. 8 is a plan view of a cone storage and conveyor systems mounted on a truck, showing the rail system and a mechanical arm employed to feed cones to the rail system or, in the alternative recover traffic cones from the rail system.

The traffic cone magazine illustrated in FIG. 8, must feed cones from the truck bed to the mechanical arm 40 when the arm is in the position illustrated in FIG. 5 to deliver traffic cones to the rail system. Alternatively, the arm can be used to clamp a cone advanced by the transverse conveyance system 63 which moves the traffic cones that are placed on the conveyor system the by the arm, to storage.

In an embodiment shown in FIG. 8, a lateral conveyor system 60 comprises a left conveyor assembly 61, a right conveyor assembly 62. These conveyors are powered by motors (not shown) that run conveyor assemblies according to signals from a control system. This control system has a sensing system (not shown) to signal it when a traffic cone is in a position to be controlled by the arm 40. For example, a traffic cone 10 can be moved by one of the conveyors so it will be in position that when the clamping plate 50 is actuated it will secure the base 11 of a cone against the platform 46. Thereafter, the control system will cause distal end 41 of the arm to swing so that its head 44 moves into the gap 28, positioning the cone between the rails 21 of the rail system 20 in a horizontal position. Once the cone is in this position, the clamping plate releases and, as the vehicle moves forward, the cone lying on the roadway will engage the arcuate guides 24 and be oriented to an upright (vertical) position as described in reference to FIGS. 1, 2, 3 and 4.

A cone stowage systems 63 in the middle of the vehicle bed in FIG. 8 is operable to deliver traffic cones to the either of the conveyors so that individual cones will move from the stowage system to a conveyor which will thereafter position it for transfer by mechanical arm 40 to the rails system 20 as previously described.

From the forgoing description it can be appreciated that this system can be operated in reverse. That is an upright cone entering between the rails 21 of the rail system with the arcuate guides 24 removed, will be knocked over by the unshaped cross bar 22 whereafter its base 11 will engage the sensor 48 on the head 44 of the arm 40. Once this occurs, the control system will actuate the clamping plate 50 and then swing the arm to a vertical position. In the vertical position of the arm, the clamping plate will release the cone, depositing it on one of the conveyors, 61 or 62. Once on a conveyor, such as conveyor 61, the cone will be moved to the cone storage system 63 in the middle of the bed and moved off the conveyor. As a result the conveyor will be ready to receive the next cone collected.

Figure 9:
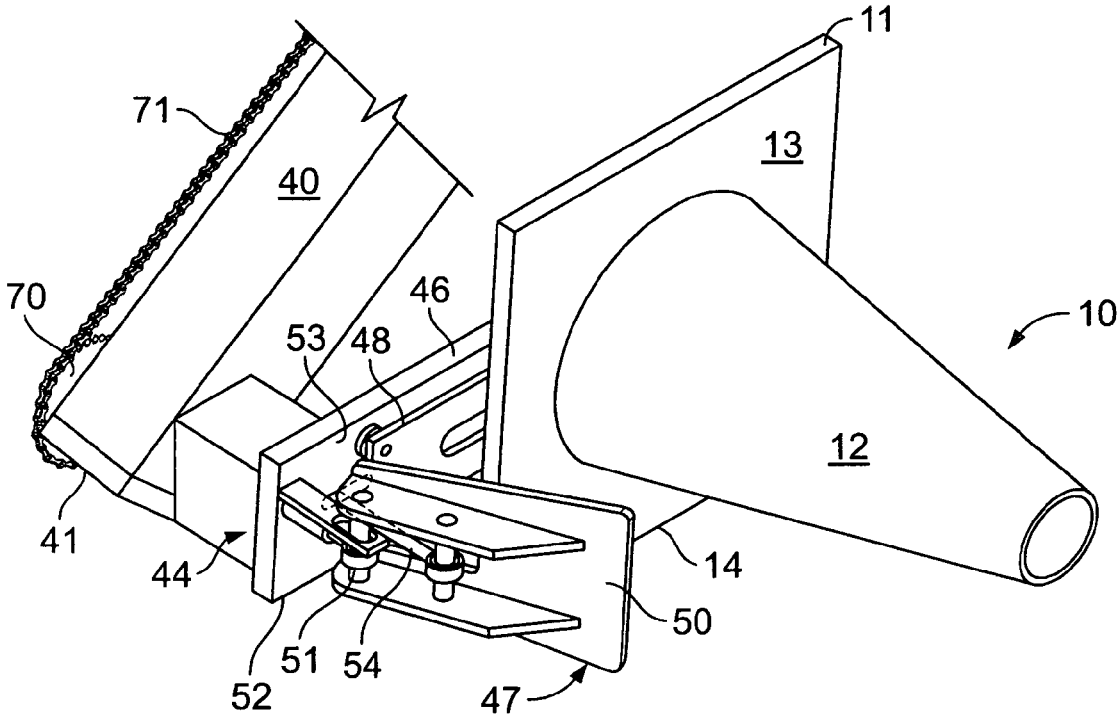
FIG. 9 is a perspective, with parts broken away, of an alternate embodiment of the mechanical arm which includes a sprocket and chain arrangement to change the orientation of the head of the mechanical arm so its head will be properly oriented whether it collects from or deposits the bed of a vehicle.

In FIG. 9 an alternate embodiment of the mechanical arm 40 is shown, which has a sprocket 70 mounted adjacent to the distal end 41 of the arm. Head 44 is mounted on a shaft (not shown) so that the orientation of the platform 46 is adjusted as the arm swings due to the control chain 71 connected to the sprocket. By controlling the size of the sprocket and the location of the ends of the control chain, the orientation of the platform can be made parallel to the roadway when the head in gap 28 of the rails 21 and parallel to the conveyor system of the vehicle when the arm moves to a vertical position. This feature ensures more accurate positioning of a traffic cone on the roadway and also on the conveyors, 61 or 62.

Indexing the head 44, in the forgoing manner, ensures better control over the flexing character of the traffic cones when manipulating them in an automatic system, especially when the ambient temperatures of the cones exceed 100 degrees F.

Figure 10:
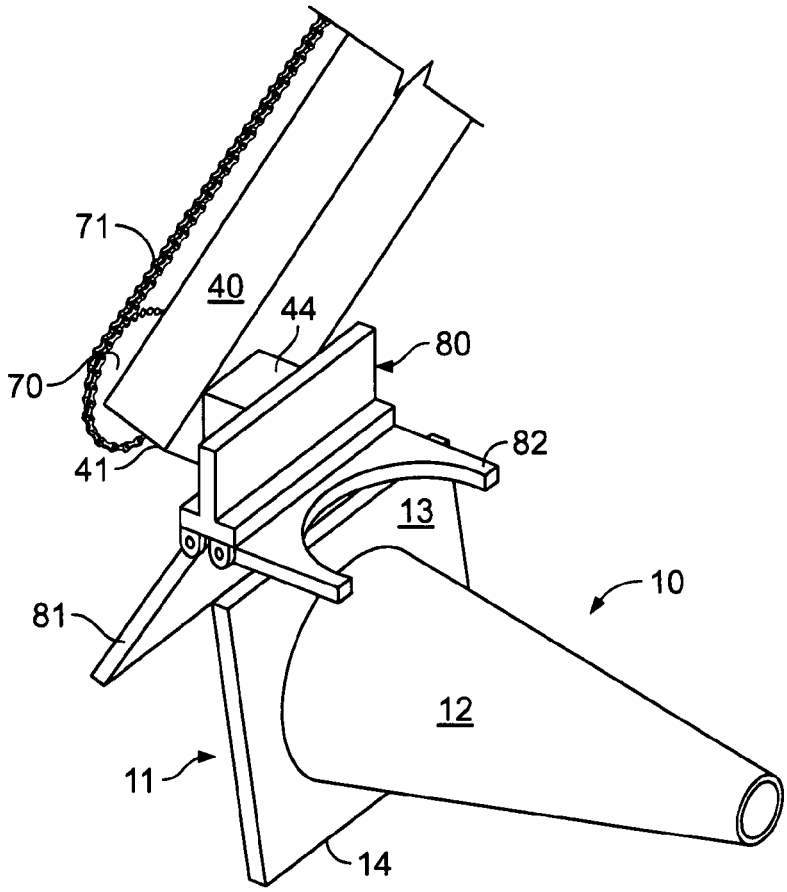
FIG. 10 is perspective, with parts broken away, of an embodiment of the mechanical arm which has the clamping system oriented vertically to better handle cones which have become flexible due to elevated temperatures.
Figure 11:
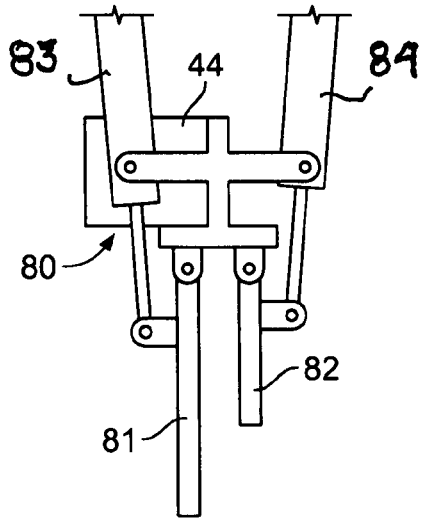
FIG. 11 is a elevation of clamping system illustrated in FIG. 10 illustrating actuators for this system.

Due the flexible characteristics of traffic cones at higher temperatures, the preferred embodiment of the mechanical arm 40 is shown in FIG. 10. In this embodiment orientation of the clamping system 80 on the head 44 is also controlled by the sprocket 70 and control chain 71, as previously described. However in this embodiment the clamping system includes a moveable platform 81 and moveable u-shaped clamp member 82, which allows greater purchase of the top of the base of the cone. By making both the platform and this clamp moveable and locating it above the cone base, the system can better compensate for mis-positioning of the cone base relative to the clamping system, both when securing a cone to move it from the truck bed to between the rails 21 or moving a cone from between the rails to one of the conveyors 61 or 62 on bed. Typical actuators for the clamping system 80 are shown in FIG. 11. Hydraulic cylinder 83 actuates platform 81 and hydraulic cylinder 84 actuates the u-shaped clamp 82 as can be appreciated from the illustration. Other actuators could be used without departing from the principle feature that outer ends of the platform and u-shaped clamp move toward one another to clamp a cone base and away from each other to release a cone base.

Figure 12:
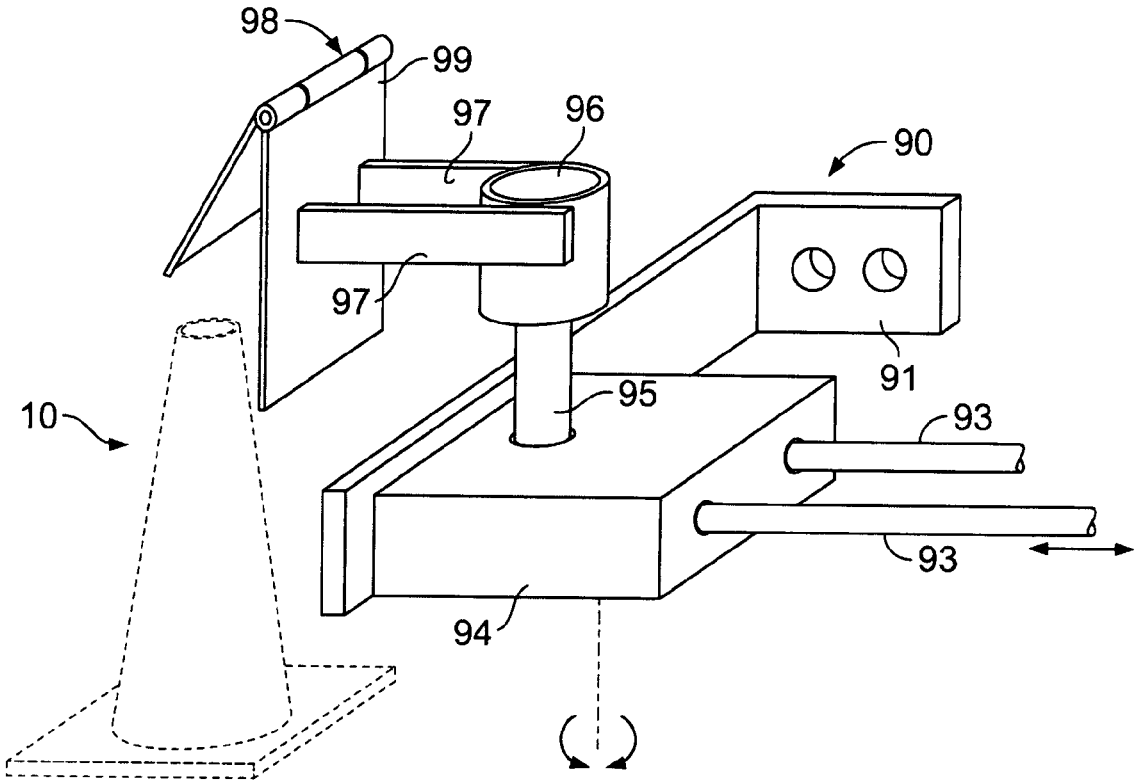

An additional feature of the present invention is the ability to use it set a traffic cone taper, such as when closing off a traffic lane. In FIG. 12 an taper system 90 is illustrated which is attached to the rear of a vehicle having the rail system 20 and is attached with brackets 91. These brackets support two arms 92 at opposite sides of the truck that support two spaced apart rods 93 there between perpendicular to the longitudinal axis of the vehicle. Mounted on the rods is a shuttle 94 that is powered to move between the arms. On the shuttle is a vertical post 95 which supports the carrier assembly 96 that has extensions 97 which support a clamp assembly 98 on their outboard ends. This latter assembly includes a generally vertical base plate 99, having a gripping plate 100 hinged at its top. The extensions ensured this clamp assembly is positioned so that the top of a traffic cone 10 leaving rail system 20 will pass between the base plate and the gripping plate as they are being distributed on a roadway.

With the top of a cone 10 between these plates, the truck is stopped and the gripping plate closes against the base plate which compresses the top of the cone there between locking the cone in the clamp assembly. At this time, carrier assembly 96 rotates 90 degrees on vertical post 95 bringing the cone secured between the plates to the rear of the vehicle. If desired, the carrier assembly can elevate the cone slightly as it rotates. Once the cone is behind the vehicle the shuttle 94 moves along rods 93 to the desired indexed position determined by the control system. For example the first cone would be taken by the shuttle to left side of the roadway and the clamp assembly activated to release the cone where after the shuttle would return to its original position and the carrier assembly would rotate 90 degrees in the opposite direction to place the clamp assembly in position to receive the next cone (as shown in FIG. 12).

The driver of the truck would then proceed forward until the top of another cone is between the plates 99 and 100, at which time he will stop and the next cone will be positioned as was the first cone, but inboard of the left edge of the roadway by the amount set by the control system to establish the desired taper.

The taper system 90 can be set to accept cone on the passenger side of the truck if desired. In addition the taper system can retrieve traffic cones by operating it in reverse of the procedures described above.

Figure 13:
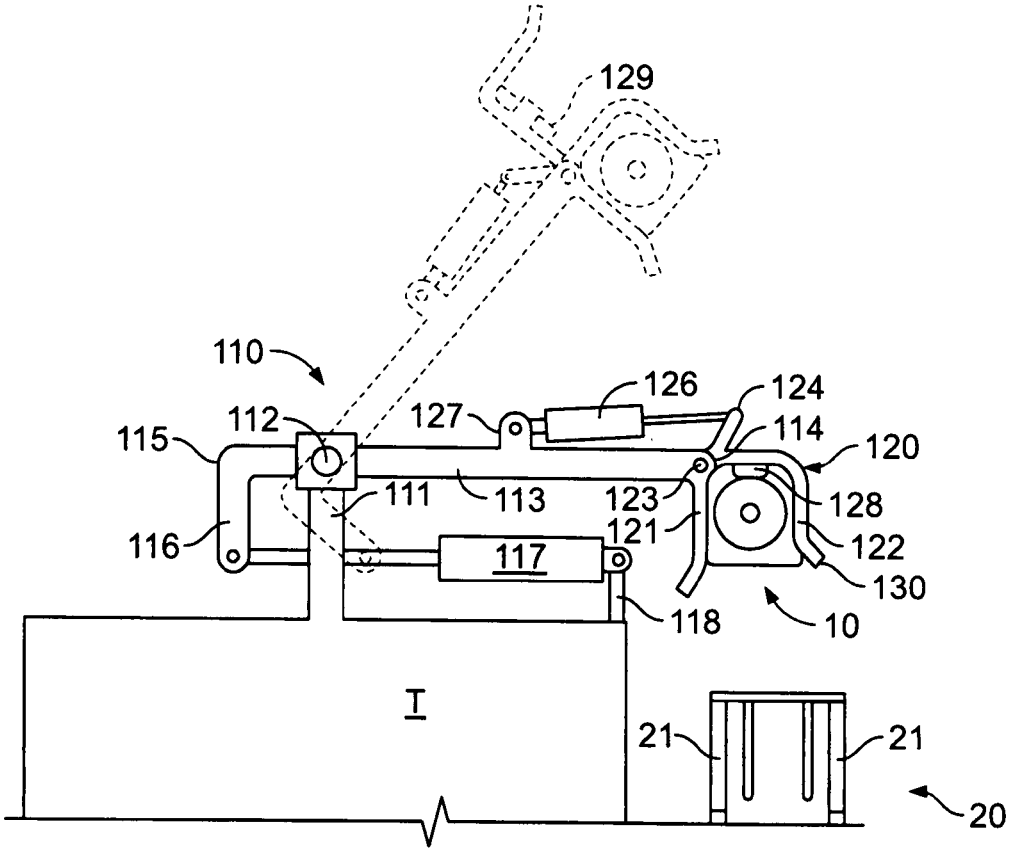
FIG. 13 is a perspective of an alternate embodiment of an ad on system for disposing traffic cones on a taper.

An alternate embodiment of the taper system 90 is illustrated in FIG. 13. In this taper system 110 a support arm 111 is mounted centrally at the rear of vehicle T having a pivot 112 at its distal end. A swing arm 113 is secured in the pivot so that its distal end 114 can swing in a 180 degree arc behind the truck. The inboard end 115 of the swing arm includes an angular extension 116 which is connected to a hydraulic cylinder 117 which is connected by a bracket 118 on the vehicle. As a result of this arrangement the distal end of the swing arm can be programmed move to desired transverse positions behind the vehicle to place a traffic cone on the desired taper.

At the distal end 114 of the swing arm 113 is a receiver assembly 120. This assembly includes a guide bar 121 fixed to the distal end so it extends at a right angle to the longitudinal axis of the arm and a pivoted c-clamp 122 secured to the distal end in a pivot 123. A lever 124 extends from the c-clamp and is connected to a hydraulic cylinder 126 that has its opposite end secured to the lug 127 on the arm. Actuations of this cylinder controls the articulation of the c-clamp which forms part of the receiver with the guide bar for a traffic cone 10 leaving the rail assembly 20 as the truck moves forward. As the cone enters the receiver a bumper 128 tips the cone so that its forward edge is lifted slightly off the roadway and becomes supported by a lip 129 at the bottom of the c-clamp as the distal end 130 of the c-clamp moves toward the guide bar. At this time cylinder 117 is actuated sliding the upright cone across the roadway to desired transverse position behind the vehicle.

Once the cone is in the proper transverse position, cylinder 126 opens the c-clamp, releasing the cone (see phantom lines in FIG. 13). With the proper control settings this alternate taper system does not require the driver to stop for each "cone set" on the taper. The alternate taper system can include rollers (not shown) under the distal end of the swing arm to accommodate uneven roadways since it tracks close to the roadway and surrounds the base of the cone of a traffic cone. Of course the other taper system 90, moving traffic cones by gripping the top of a traffic cone, is not challenged by uneven roadways.

Figure 14:
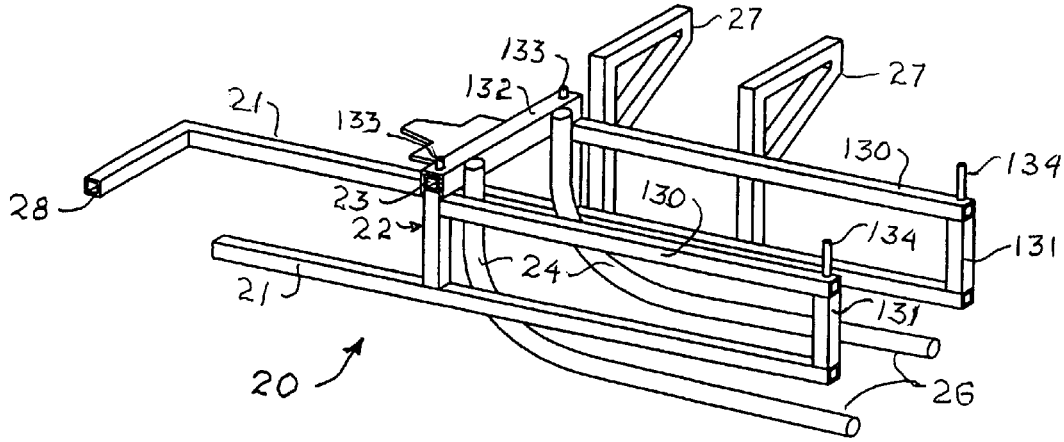
FIG. 14 is a perspective of a commercial embodiment of the rail system.

Referring to FIG. 14, a commercial embodiment of the rail system 20, it essentially has the same components previously described but includes additional superstructure composed of upper tubular members 130 connected between the u-shaped cross bar 22 and an upstanding support posts 131 above each rail 21, as can be seen in FIG. 14. Instead of fixing the arcuate guides 24 in the top 23 of the cross bar as previously shown, they are connected to a inverted u-shaped cap 132 that drops on to the top 23 of the cross bar and is secured on guides pins 133 extending from the top of cross bar. As a result the arcuate guides may be easily removed when desired, such as when converting the rail system to the collection mode to pick up traffic cones previously deposited on a roadway, see FIG. 15 with the arcuate guides removed.

The perspective in FIG. 15 illustrates the set up mode for a commercial version of the rail system for recovering traffic cones. In this mode a recovery guide 134 is position on guide pins 135 projecting above the support posts 131 by positioning its connecting bar 139, that connects its two, spaced apart side rails 136, on these pins as shown. These sides rails are identical and provide aft extension of rails 21 on each side of the rails system 20 to guide traffic cones to locations that are between these rails. At the distal ends 137 of the side rails a downwardly directed leg 138 is provided to provide guidance for cones which have been overturned prior to their collection.

In operation, when a upstanding traffic cone enters to the space between the side rails 136 it will be knocked down (knocked over to a horizontal position) by the connecting bar 135 with its base passing under an inverter guide 140 which is hinged on the connecting bar 134 as the vehicle moves rearward to collect the traffic cones. The inverter guide has an arcuate cutout which has a slightly larger radius than the base of the cone of the traffic cones being collected. If a cone is received base first and in a horizontal position, the inverter guide swings up on it hinges and will allow the cone to pass. However if a traffic cone is received in a horizontal position, but with the top of the cone first, the cone section will pass under the arcuate cutout in the inverter guide but the guide will engage the top of the base of the cone and bring the cone to an upright position. As the rail system continues to remove rearwardly the u-shaped cross bar 22 will knock the up right cone over so that its base will be the first part of the cone contact the sensor on arm 40.

As can be appreciated from the forging description, all traffic cones entering between the side rails 136 will be manipulated so that every cone approach the arm 40, base first, when the rail system 20 is moved rearwardly to collect traffic cones.

As a traffic cone tracks between rails 21, its base will move under the head 44 of the arm 40 at which time a sensor (such as shown in FIG. 7) will detect its position and close the platform 81 and u-shaped clamp 82 (shown in FIG. 10) onto the base securely locking such a traffic cone therein. Once a traffic cone is secured in the head 44 of the arm 40 as described the arm is raised, lifting the secured traffic cone to the bed of the truck.

Figure 16:
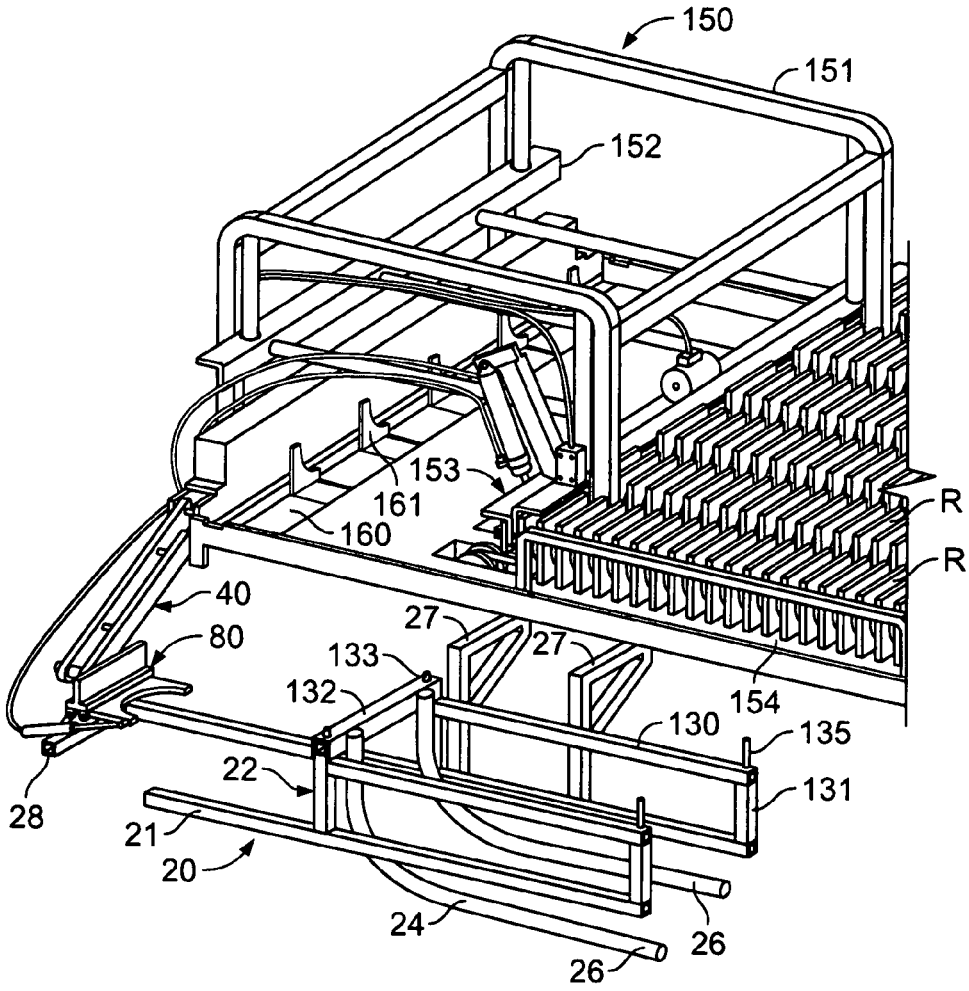
FIG. 16 is perspective, with some parts broken away, illustrating the main components of a commercial embodiment of the novel cone handling system, including a cone magazine and the rail system according to this invention.

Whether traffic cones are being taken from the bed of a truck to deposit them on a roadway, or being placed on a bed of a truck during recovery of traffic cones from a roadway, the magazine system 150 illustrated in FIG. 16, enables complete automation. In general, this commercial embodiment includes an elevated superstructure 151 above the bed of a vehicle that carries a vertical reciprocating platform 152 below its top. The platform has a fork system 153 (best shown in FIG. 17) to handle multiple rows R of nested traffic cones axially aligned on the bed 154 by raising and lowering this system.

Figure 17:
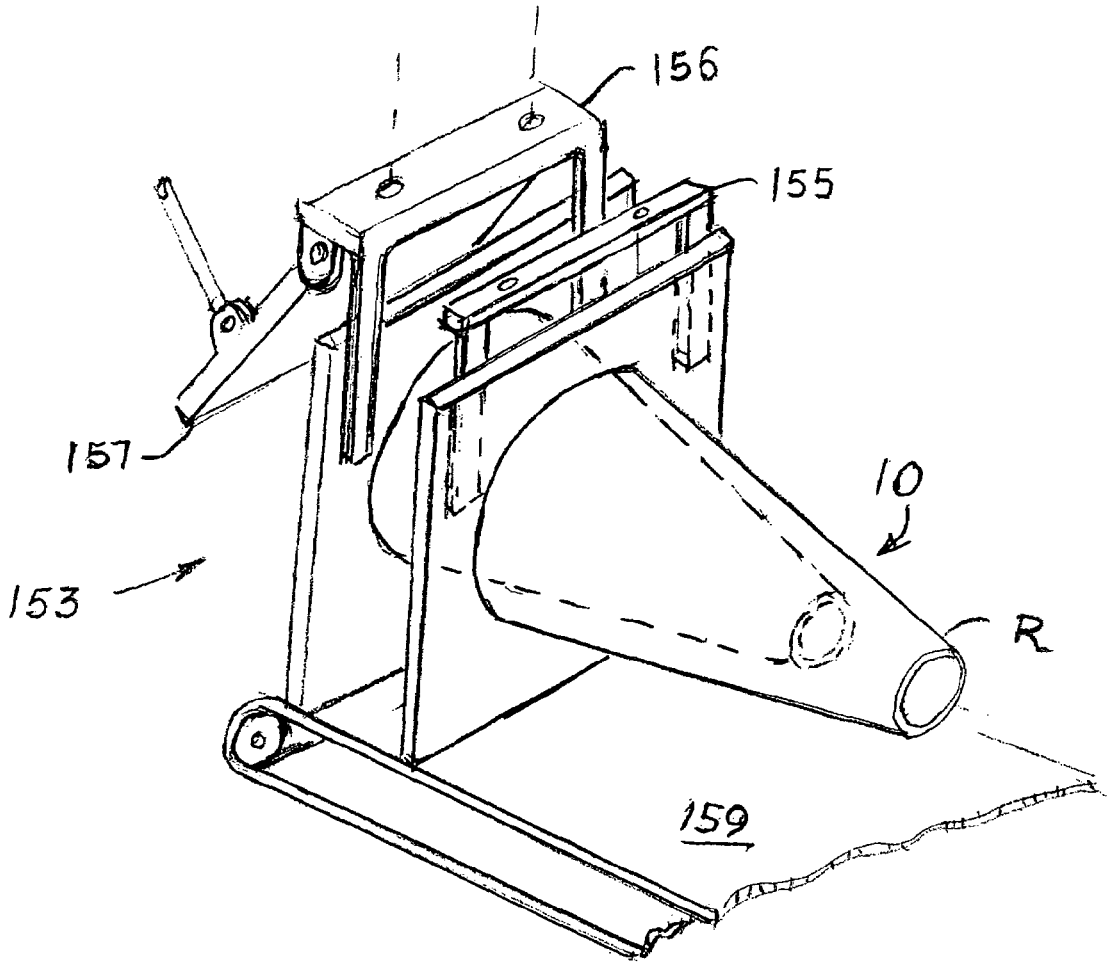
FIG. 17 is an perspective of the fork system of the cone magazine shown in FIG. 16 associated with a row of cones on a longitudinal conveyor, with parts broken away.

Referring to FIG. 17, the fork system consists of two vertically reciprocating forks, 155 and 156. The stabilizing fork 155 is lowered to prevent more than one cone or, more than one transverse row of cones, from being moved by the transfer fork 156 at one time. The transfer fork includes a clamp plate 157 which, when the transfer fork has engaged (or is adjacent to) the top of the bases in the first transverse row of traffic cones, closes to secure the bases of the entire transverse row of cones on the transfer fork. This fork typically has multiple fork like projections, which when it is lowered, are positioned adjacent to tops of the bases of the traffic cones in the transverse row of cones. Once a transverse row of cones are secured on the transfer fork it moves the entire transverse row of cones forward to the transverse conveyor 160 at the front of the bed. It can be appreciated that during this time the stabilizing fork 155 has retained all the cones in the second transverse row of cones in their position enabling the transfer fork to pull the longitudinally stacked (nested) cones apart.

Once the transfer fork 156 has moved the cones to transverse conveyor 160 the clamp 157 opens and the forks 155 and 156 are raised as the platform 152 rises. At this time the transfer fork moves toward the stored rows of cones and the feed conveyor 159 under the longitudinal rows of nested cones move them forward so that another transverse row of cones can be engaged by the transfer fork. With the cones sequenced forward by feed conveyor, both forks are lowered and the clamp plate actuated to secure a transverse row of cones on the transfer fork for the next cycle.

Once the cones in storage have been stabilized with platform 152 lowered, as described in the previous paragraph, the first cone on the transverse conveyor 160 will be in position to be accessed by the clamp 80 on arm 40. As a result, the process whereby a cone is delivered from the vehicle bed to a position between the rails 2, can be effected. Thereafter, the transverse conveyor will move the next cone in position to be accessed by the clamp on arm 40. It should be appreciated that the transverse conveyor can deliver cones to, either the driver's side or the passenger side, of the vehicle by simply reversing its direction. This enables the rail system 20 to be operated on both sides of a vehicle, when equipped with an arm on both sides of the vehicle.

While the transverse conveyor 160 can be a simple belt type conveyor, in the commercial embodiment shown in FIG. 16, it includes pop up brackets 161 to engage the traffic cones to ensure that the cones are positively located on the conveyor as it sequences, even when the cones are at elevated temperatures and are unusually flexible.

Magazine 150 is fully compatible with collecting traffic cones which have been previously deposited on a road. The arrangements for guiding upstanding traffic cones, as well cones which have been knocked over, to the mechanical arm 40 where after they will be delivered to the bed of the a vehicle has been described. In this magazine the cones will be delivered to the traverse conveyor 160. Once a cone is delivered to the conveyor and the arm cycles back to the rail system 20 to access the next cone, the transverse conveyor will actuate brackets 161 and move delivered cone inboard, one cone space. This cycle is repeated until the transverse conveyor has a row of five cones thereon.

At this time the clamp plate 157 opens and the platform 152 raises fork 156. Once the transfer fork is raised the system moves it forward to the transverse row of cones on the transverse conveyor at which time the platform lowers the transverse fork 156 so it is adjacent to the tops of the bases of the cones on the transverse conveyor. At this time clamp plate 157 is closed and secures the bases of the cones between it an the transfer fork. As this occurs the ends of the cones are raised so that their respective tops will nest with an axial rows of cones in storage as the transverse fork moves the row of cones from the transverse conveyor to the nested cones in the storage area. The stabilizing fork 155 will retain these axial rows of nested cones so that the cones from the transverse conveyor will properly nest.

As to the control system it is fairly conventional, employing sensors to determine the locations of the traffic cones and the positions of the movable members in the novel system. A programmed computer can be used, or if desired, or in the alternative ladder logic modules to sequence, the system. Since the sequence of the of parts of the novel systems has been described the programming is straight forward. The control system includes a timer which can be set to control the spacing of the cones on the roadway by controlling the time interval of the delivery of traffic cones to the rail system 20 to set the interval between cones.

The novel system when mounted on a vehicle can be operated at speeds up to 10 miles per hour but preferably in the range of 8 miles per hour for best performance. Typically the timing is set to space the cones at 25 foot intervals, 50 foot intervals or 100 foot intervals which is set by the operator. Other intervals for cone spacing can also be accommodated. An input representing the speed of the vehicle is sent to the control system so that interval between the cones can be controlled relative to the vehicle speed.

Having described my invention I claim:

1. An automated traffic cone handling device for handling traffic cones on a roadway surface comprising:

a truck mountable rail system having two spaced apart rails for mounting slightly above a roadway and for orientation parallel to the longitudinal axis of the truck when so mounted;

arcuate guide means mounted adjacent to each of said rails, said guides means operable to engage the base of traffic cone to orient such cone to a vertical position from a horizontal position as such cone moves along said rails from roadway friction on one edge of such cone base and said guides means engaging the top of such cone base; and a cone magazine means cooperating with said rails operable to sequentially deposit horizontally disposed traffic cones between said rails one after another said rails are moved along a roadway.

2. The automated traffic cone handling device for handling traffic cones on a roadway surface defined in claim 1 wherein the cone magazine includes a swingable arm means with a clamp means at its distal end operable to secure the base of a traffic cone; and control means operable to move a clamped cone from a cone storage area to a position between the rails in a horizontal position on a roadway and releasing such cone.

3. The automated traffic cone handling device for handling traffic cones on a roadway surface defined in claim 1 wherein the cone magazine means includes a timer means operable to sequentially deliver such traffic cones on a roadway between the rails at a controlled delivery rate.

4. The automated traffic cone handling device for handling traffic cones on a roadway surface defined in claim 1 wherein the spaced apart rails are parallel to one another with adjusting means connecting them together operable to adjust the distance between said rails to accommodate traffic cones of different sizes.

5. The automated traffic cone handling device for handling traffic cones on a roadway surface defined in claim 4 wherein the arcuate guide means is removed and replaced by a transverse bar and the control means associated with the swingable arm means is operable to position said arm between the rails with its clamp means open and to cause the clamp means on the swingable arm means to grip the base of a traffic cone between said rails when said rails move rearwardly so the base of such cone actuates said clamp means and said arm thereafter moves such cone to a cone storage area.

6. An automated traffic cone handling device for handling traffic cones on roadways comprising:

a motive means operable to move along a roadway;

a rails system means having a pair of spaced apart parallel rails with arcuate guide means mounted adjacent to each rail, mounting means operable to connect said rail system means to said motive means so that said rails are parallel to the longitudinal axis of said vehicle and positioned slightly above the roadway on which the vehicle is located; and a traffic cone magazine means operable to sequentially delivery traffic cones in a horizontal position to a location between said rails and forward of said arcuate guide means whereby said arcuate guide means are operable to engage the top of the base of such a traffic cone as said vehicle movers forward and the friction on one edge of such base jointly force such cone to a vertical position.

7. An automated traffic cone handling device for handling traffic cones on roadways defined in claim 6 wherein the parallel rails are located above the roadway by a distance greater than the thickness of the base of a traffic cone being deposited on a roadway.

8. A method of depositing traffic cones on a roadway comprising the steps of moving a pair of spaced apart rails along a path above a roadway on which traffic cones are to be deposited;

sequentially placing traffic cones on such roadway between said rails in a horizontal position;

employing arcuate guide means associated with each of said rails operable to engage the top of the base of such traffic cone whereby the friction of the roadway on one edge such base will bring the horizontally disposed cone to an up right position as said rails move along such roadway.

9. The method defined in claim 8 wherein the path of the rails along the roadway is provided by a moving vehicle to which said rails are attached so their longitudinal axis is parallel to the longitudinal axis of said vehicle.

10. An automated traffic cone handling device for handling traffic cones on a roadway comprising:

motive means operable to transverse a roadway containing a row of traffic cones on such roadway;

a pair of spaced apart parallel rail means mounted on said motive means so it is positioned above such roadway and parallel to the longitudinal axis of said motive means;

first bar means mounted on said rail means operable to tip over such upright traffic cones received between said rail means as said motive means moves said rail means along such line of cones;

a cone orientating means mounted between said rail means operable to upright any such traffic cones in a horizontal orientation received cone first between said rail means;

second bar means mounted on said rail means operable to tip over any such traffic cone brought to an upright position by said cone orientating means; and a cone transport means associated with said rail means operable to sequentially retrieve such cones which have been tipped over by one of said bar means between said rail means and deposit such cones in a cone storage area on said motive means.

11. An automated traffic cone handling device for traffic cones defined in claim 10 wherein the motive means is a truck.

12. An automated traffic cone handling device for traffic cones defined in claim 10 wherein the cone orientating means includes a panel horizontally hinged between the rail means, said panel having an arcuate aperture for passage of tops of such traffic cone thereunder and operable to engage the bases of such traffic cones subsequent to the passage of such top thereunder to bring such traffic cones to an upright position, said hinged panel operable to allow such traffic cones received between said rail means base first to pass said cone orienting means without changing the orientation of such cone.

13. An automated traffic cone handling device for traffic cones defined in claim 10 wherein the cone transport means includes a swingable arm means articulated on the motive means with a clamp means at its distal end operable to engage the base of each such traffic cone received between the rail means when such cone engages said clamp means, to clamp said base in said clamp means, to swing such clamped cone on to said motive means and to release such traffic cone on said motive means.

14. An automated traffic cone handling device for traffic cones defined in claim 10 wherein the motive means includes a cone conveyor means operable to move such traffic cones released onto said motive means by the swingable arm means to a storage area to make room for the next such traffic cone.

15. A cone magazine for storing and dispensing traffic cones comprising:

a motive means operable to move along a roadway;

a first conveyor means mounted on said motive means operable to transport such traffic cones thereon transverse to the longitudinal axis of said motive means;

a second conveyor means mounted on said motive means operable to transport such traffic cones parallel to the longitudinal axis of said motive means located adjacent to said first conveyor means;

overhead fork means adjacent to said first and second conveyor means, having vertical reciprocating forks operable to engage such traffic cones on said second conveyor means and to move such cones to said first conveyor means; and control means connected to said first conveyor means, said second conveyor means and said fork means operable to sequence the movement of such traffic cones between said conveyor means and to control the movement of said conveyor means.

16. The cone magazine defined in claim 15 wherein the first and second conveyors include flexible belts for transporting such traffic cones deposited thereon.

17. The cone magazine defined in claim 15 wherein the second conveyor is operable to control multiple rows of telescoped traffic cones thereon.

18. The cone magazine defined in claim 15 wherein the overhead fork means includes a vertically retractable fork element which is operable to engage the top of the each base of such traffic cones while they are in a horizontal position when said fork means is extended and clamp panel operable to engage the under side of such base of such traffic cones to secure at least one of such traffic cones in said fork means so such secured traffic cones can be transported between the first and second conveyor means.

* * * * *